United States Patent [19]

Fletcher

[11] 4,160,437

[45] Jul. 10, 1979

[54] ARCHERY BOW STRING RELEASE DEVICE

[76] Inventor: James D. Fletcher, P.O. Box 218, Bodfish, Calif. 93205

[21] Appl. No.: 859,330

[22] Filed: Dec. 12, 1977

[51] Int. Cl.[2] ..... F41B 5/00

[52] U.S. Cl. ..... 124/35 A

[58] Field of Search ..... 124/35 A, 23 R, 24 R, 124/41 A

[56] References Cited

U.S. PATENT DOCUMENTS

| | | | |
|---|---|---|---|
| 229,089 | 6/1880 | Burnham | 124/35 A |
| 2,000,015 | 5/1935 | Flury | 124/35 A |
| 2,488,597 | 11/1949 | Konold | 124/35 A |
| 3,898,974 | 8/1975 | Keck | 124/35 A |
| 4,036,204 | 7/1977 | Scott | 124/35 A |
| 4,041,926 | 8/1977 | Troncoso et al. | 124/35 A |

*Primary Examiner*—Richard C. Pinkham
*Assistant Examiner*—William R. Browne
*Attorney, Agent, or Firm*—Donald E. Nist

[57] ABSTRACT

A unitary bowstring-holding member in the form of a frame having an integral pair of spaced, opposed resilient clamp jaws, the resiliency thereof being due to the nature of the frame. The device also includes a trigger member having a forked portion intercepting the frame and pivotably connected to one of the jaws, and a link pivotably connected to the other of the jaws and to the forked portion so that movement of the trigger member in a first direction (through the link) forces the jaws toward each other into a bowstring-holding closed position and so that movement of the trigger member in the opposite second direction permits sudden bowstring-releasing opening of the jaws.

10 Claims, 8 Drawing Figures

ARCHERY BOW STRING RELEASE DEVICE

BACKGROUND OF THE INVENTION

1. Field of the Invention

The present invention generally relates to archery equipment and more particularly relates to archery bowstring devices of an improved type.

2. Prior Art

Mechanical archery bowstring release devices are becoming increasingly popular because they facilitate accurate shooting more easily and more rapidly than do older, more traditional forms of bowstring equipment, including finger tabs, gloves and stalls. Most of the mechanical release devices employed heretofore feature single point contact with the bowstring. A typical one of such single point contact devices comprises a hook which engages the bowstring and is drawn with the fingers of one hand. It is then turned or rotated when the bowstring is at full draw in order to allow the bowstring to slip around the end of the hook. One disadvantage which may occur with this type of release is a tendency to misalign the bowstring relative to the vertical centerline of the bow. Moreover, it is somewhat difficult to precisely duplicate the hand-head-string and bow limb-alignment from shot to shot at the moment of release of the bowstring from such a device. When the bowstring is forced out of center alignment at the moment of release from such a device it describes a serpentine path as it moves forward, transferring propulsive force to the arrow shaft at an angle from the longitudinal axis of the shaft, causing the shaft to bend in much the same fashion as but to a lesser extent than in the case where the bowstring is released from finger tabs, stalls or gloves.

In order to overcome the deficiencies of both the tab, glove and stall type of release and single point contact mechanical releases, certain mechanical devices have been constructed to include loops of, for example, rope or cord around the bowstring. At the moment of release of the string from such a device, one end of the cord is released so that the cord is shoved out of the way by the bowstring. This has the beneficial tendency of dampening bowstring vibrations with some decrease in bowstring energy but still does not always provide optimally smooth, uniform bowstring release in a straight line forward.

The most efficient type of mechanical release thus far devised is the so-called clamp or caliper type, for example, as shown in U.S. Pat. No. 4,041,926. With this type of device, the bowstring is clamped and held between a pair of opposable jaws which, upon the moment of release, are forced apart suddenly to release the bowstring straight forward towards the target. Such a device is much easier to use than previous devices and usually has a positive locking mechanism which assures that the bowstring during drawing by the archer will not be inadvertently released. Such a device may include, however, a considerable number of precisely machined parts, some of which are easily worn, such as springs, rollers, etc. Moreover, such devices are usually of complicated design and of relatively high cost to produce.

It therefore would be desirable to provide an improved bowstring release device which would have all of the features of conventional clamp release devices, including bowstring release directly forward without string drag or torque and a positive locking mechanism, but which would also be of simpler, more durable, less expensive construction. Preferably, such device would not employ any mechanism such as a spring or the like which could change performance or wear out easily. The device should also be capable of being utilized in a plurality of shooting modes to suit the individual shooting style of the archer.

SUMMARY OF THE INVENTION

The present invention satisfies all of the foregoing needs. Thus, the invention is substantially as set forth in the Abstract above. It comprises an improved bowstring release device which is simple, highly efficient, of the clamp type and is durable. It need not employ any more than three components and need not utilize separate springs, rollers, or other easily wearable parts. It is inexpensive to manufacture from easily available materials.

It includes a unitary bowstring-holding member in the form of a frame having an integral pair of spaced opposed resilient clamp jaws formed therein. The frame is preferably of hardened aluminum alloy. The jaws have inherent spring biasing keeping them apart but can be urged into closed position. When released from that position, they spring apart. Thus, the need for a separate spring mechanism is obviated.

The frame is fitted to a trigger member which intersects the frame and is disposed around a portion thereof. The trigger member is pivoted to one of the jaws while a link is pivotably connected to the other of the jaws and the trigger member. Movement of the trigger end of the trigger member in a first direction forces the link against one of the jaws causing the jaws to close into a bowstring-holding position. When the jaws are fully closed the link is in a stable stationary jaw-locking position. Movement of the trigger end in the opposite direction urges the link out of this locked position so that the spring action of the jaws can operate to suddenly open the jaws and release the bowstring.

The device can be held in the hand with one or more fingers engaging the trigger portion of the trigger member to move it into and out of the jaw-locking position. The device can be fitted with a wrist strap, if desired, to aid in drawing the bowstring. The device may also be fitted with a cross handle pivoted to the frame at a point remote from the jaws and fitted with a cord or the like linking it to the trigger end so that pivoting of the handle will cause the cord link to move the trigger end in the same direction as the handle to release the string. Thus, the improved release device of the invention can be provided in a number of forms, all of which are simple, durable, inexpensive and highly efficient. The device can easily be adapted to the particular needs of the individual archer. It can be constructed almost entirely of aluminum or other light metal, provided, however, that the frame has the requisite inherent spring action.

Further features of the present invention are set forth in the following detailed description and the accompanying drawings.

DRAWINGS

DETAILED DESCRIPTION

FIGS. 1-5

Figure 1:
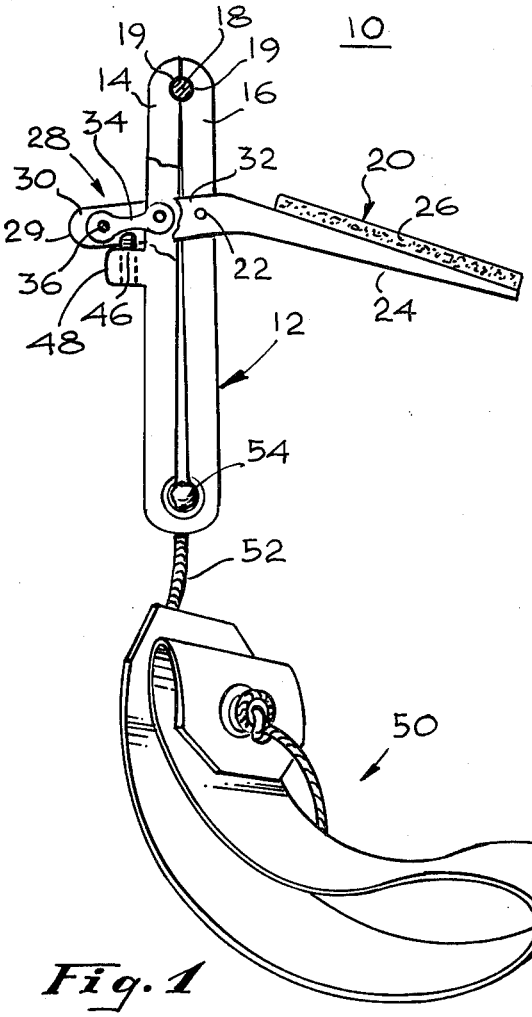
FIG. 1 is a schematic top plan view, partly broken away, of the first preferred embodiment of the improved release device of the present invention, together with a wrist strap, the device being in a closed, bowstring-holding position.

Now referring more particularly to FIG. 1 of the accompanying drawings, a first preferred embodiment of the improved release device of the present invention is schematically depicted therein in top plan view. Thus, device 10 is shown which comprises a bowstring-holding member in the form of a one piece frame 12 having an integral pair of normally spaced, opposed, resilient closeable clamp jaws 14 and 16. Jaws 14 and 16 can be readily biased to a closed position, but when released from the biasing force, spring apart. Frame 12 and jaws 14 and 16 may be of a hard, durable, preferably light, material, such as hardened aluminum alloy. Any other metal, such as copper, brass, unalloyed aluminum, steel or the like, which can be treated to provide the requisite spring action of jaws 14 and 16 can also be used. Frame 12 preferably is elongated, narrow and thin with jaws 14 and 16 at the forward end thereof, capable of retaining a bowstring 18 in matching, semi-circular, radiused string grooves 19 when in the closed position, as shown in FIG. 1. Frame 12 is fabricated from a single piece of material, as by slitting, drilling, grinding, sanding, or the like.

Figure 2:
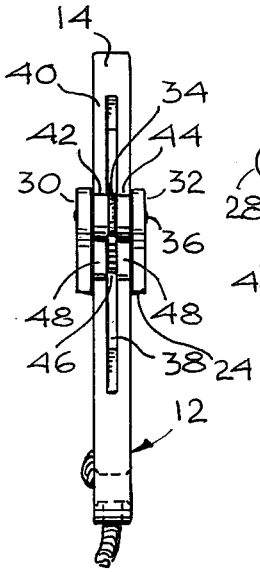
FIG. 2 is a schematic side elevation of the improved device of FIG. 1.

Device 10 also includes an elongated trigger member 20, preferably of durable metal, but which can be of plastic, wood or the like, and which intersects the frame and is pivotably connected to jaw 16 at point 22. Trigger member 20 includes an elongated trigger blade 24 adjacent one end thereof with an attached resilient cushion 26 of, for example, foamed rubber, plastic or the like, and a forked portion 28 on the opposite end 29 thereof, which portion 28 has a pair of tines 30 and 32 (FIG. 2) enclosing a portion of jaws 14 and 16 and extending lateral thereof, as shown in FIG. 1.

Device 10 further includes a link 34, preferably of steel or the like, which is pivotably connected adjacent one end thereof to tines 30 and 32 at points 36 lateral of jaw 14 and adjacent end 29. Link 34 is also pivotably connected, adjacent its opposite end, to jaw 14 in the area of portion 28. As will be noted from FIG. 2, an elongated groove 38 is provided in the outer side 40 of jaw 14 within which link 34 is received. Spacers 42 and 44 at point 36 center link 34 relative to groove 38.

Figure 3:
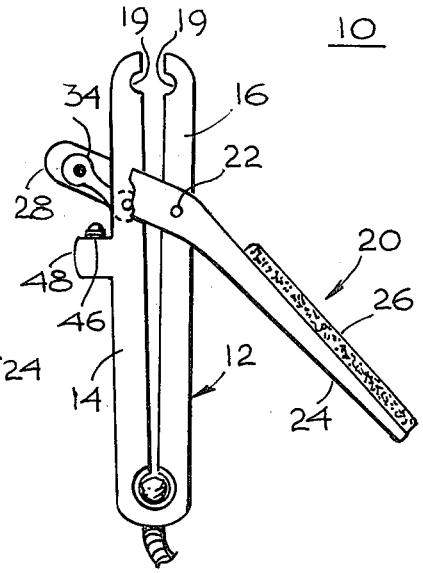
FIG. 3 is a schematic top plan view, partly broken away, of the device of FIG. 1 in the open jaw position.
Figure 4:
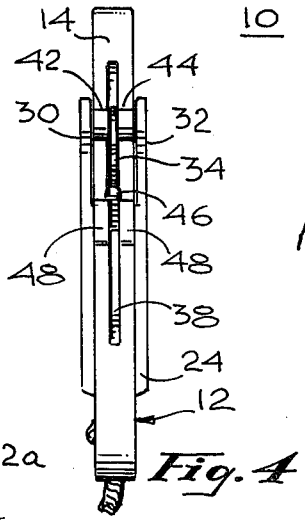
FIG. 4 is a schematic elevation of one side of the device of FIG. 1 in the closed jaw position.
Figure 5:
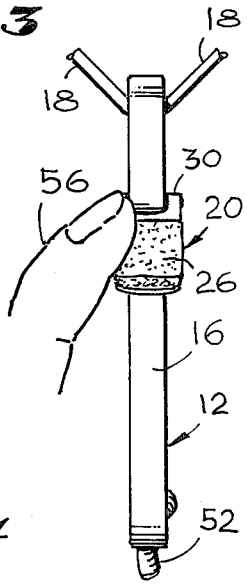
FIG. 5 is a schematic elevation of the opposite side of the device of FIG. 1 in the closed jaw position, around a drawn bowstring and with the archer's finger ready to cause release of the bowstring.

Link 34 is dimensioned such that when blade 24 is moved forward towards string grooves 19, link 34 is forced to pivot with portion 28 from its forwardly projecting position of FIG. 3 to the generally laterally slightly rearwardly projecting position of FIG. 1. This movement of link 34 causes it to bias jaw 14 towards jaw 16 until the closed-jaw, string-holding position of FIG. 1 is attained. In that position, jaws 14 and 16 are locked together. Link 34 is now in a stable, stationary locked position, with tines 30 and 32 and link 34 slanting slightly rearwardly, that is, past center. The extent of such rearward slant is controlled by an adjustable screw 46 threadably received within protrusion 48 extending laterally of jaw 14. Screw 46 abuts the rear end of link 34 between its two pivot points (FIG. 1).

In order to open jaws 14 and 16, link 34 must be pivoted forward at points 36 a regulatable amount, by rearward finger pressure on cushion 26. The length of travel of blade 24 rearwardly necessary to move the portion of link 34 at points 36 to a position forward of center, that is, forward of a line perpendicular to the longitudinal axis of frame 12 can be controlled by screw 46. When that position is reached, jaws 14 and 16 are automatically unlocked and their spring action, tending to bias them apart, comes into effect, causing them to suddenly separate, thereby releasing bowstring 18 suddenly, smoothly and straight ahead with no drag and no side torque thereon.

In order to facilitate drawing of the bowstring 18 by device 10, device 10 may include a wrist strap 50 (FIG. 1) connected to the rear end of frame 12, as by an adjustable cord 52 or the like through an aperture 54 in frame 12. Other drawing aids may be used in place of strap 50, if desired, for example, a cross handle such as is more particularly described hereinafter. In use, device 10, with jaws 14 and 16 open (FIG. 3) is placed around bowstring 18 with strap 50 in place on the archer's wrist. Then jaws 14 and 16 are closed (FIG. 1), whereupon movement of the archer's draw hand rearwardly draws the bowstring. When the archer is at full draw, slight rearwardly movement of finger 56 on cushion 26 and blade 24 will unlock jaws 14 and 16 and cause sudden release of the bowstring, as previously described. Thus, device 10 is simple, durable, inexpensive and highly efficient.

FIG. 6-8

Figure 8:
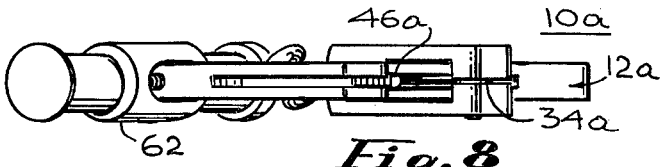
Figure 6:
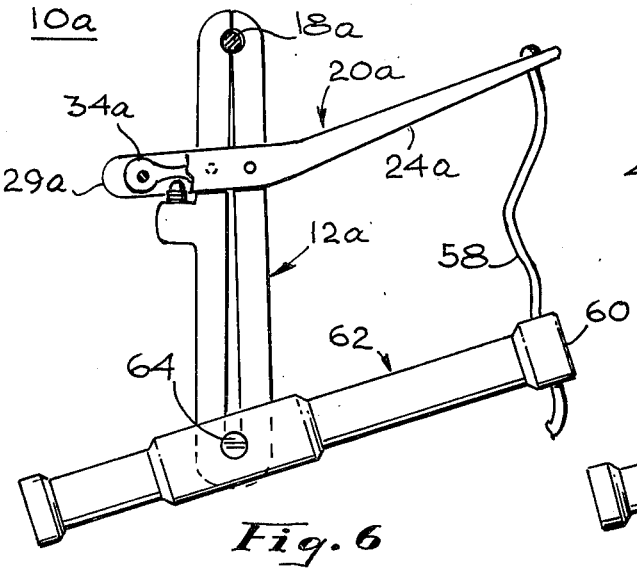
FIG. 6 is a schematic top plan view, partly broken away, of a second preferred embodiment of the improved release device of the present invention, shown in the closed jaw position.
Figure 7:
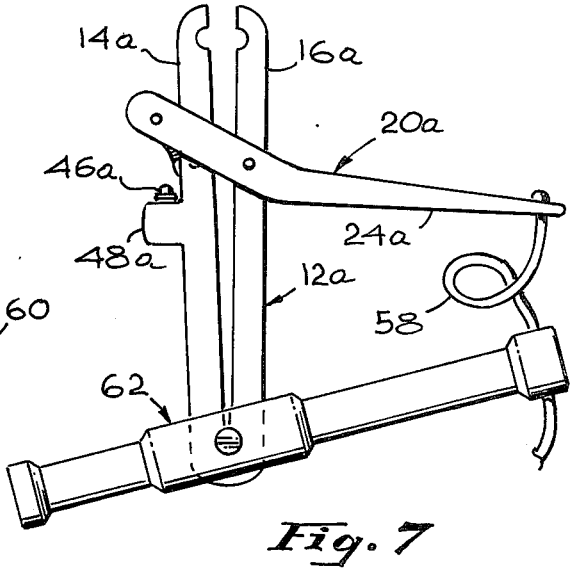
FIG. 7 is a schematic top plan view of the device of FIG. 6 shown in the open jaw position; and, FIG. 8 is a schematic side elevation of the device of FIG. 6 in the open jaw position.

A second preferred embodiment of the improved release device of the invention is schematically depicted in FIGS. 6-8. Thus, device **10*a* is shown which is substantially similar to device 10 and functions similarly thereto. Components of device 10*a* similar to those of device 10 are similarly numbered but are succeeded by the letter "a". Thus, frame 12*a* and link 34*a* are substantially identical, respectively, to frame 12 and link 34. Adjustment screw 46*a* is also provided. Trigger member 20*a* is substantially the same as trigger member 20, except that blade 24*a* may be angled, as shown in FIGS. 6 and 8, slightly differently than blade 24**.

No cushion is present on blade **24*a*. Instead, blade 24*a* is moveable rearwardly through a flexible link in the form of a cord 58 connected to one end 60 of a cross handle 62 pivotably connected at point 64 to the rear end of frame 12*a*. Cord 58 is long enough to allow member 20*a*, specifically end 29*a* thereof, to be urged, as by the archer's fingers, into the closed jaw starting position depicted in FIG. 6. After full draw is reached, slight rotation of the archer's hand in the proper direction while it grips handle 62 will effect rearward tugging of blade 24*a* by cord 58 and sudden opening of jaws 14*a* and 16*a* to effect smooth release of the bowstring 18*a*. Thus, device 10*a* can be made of components similar to those of device 10 and has the advantages of device 10**, but permits the archer to utilize a different hand action to effect release of the bowstring.

Various other mdifications, changes, alterations and additions can be made in the present invention. All such modifications, changes, alterations and additions as are within the scope of the appended claims form part of the present invention.

What is claimed is:

1. An improved archery bowstring release device comprising, in combination:

a. a unitary bowstring-holding member in the form of a resilient one piece frame having an integral pair of spaced, opposed, engageable resilient clamp jaws;

b. a trigger member intersecting said frame and pivotably connected to one of said jaws; and, c. a link pivotably connected to the other of said jaws and to said trigger member, whereby movement of said trigger member in a first direction acts through said link to force said jaws toward each other into a bowstring holding closed position, and whereby movement of said trigger member in the opposite second direction permits sudden bowstring-releasing springing open of said jaws due to their inherent resiliency.

2. The improved release device of claim 1 wherein said device consists of said frame, trigger member and link and is devoid of a separate spring component.

3. The improved release device of claim 1 wherein said link is in a stable, stationary, resting, jaw-locking position, when said jaws are closed.

4. The improved release device of claim 3 wherein said frame includes means for adjusting the position of said link in said jaw-locking position and the extent of movement of said trigger member necessary to upset said link and permit said frame spring action to move said jaws into said suddenly open bowstring-releasing position.

5. The improved release device of claim 4 wherein said adjusting means includes a threaded screw adjustably positionable to bear against said link.

6. The improved release device of claim 1 wherein said frame is generally U-shaped with said jaws adjacent one end thereof, and wherein said frame comprises hardened aluminum alloy.

7. The improved release device of claim 1 wherein said device includes a cross handle pivoted to said frame at a point remote from said jaws and wherein said handle is directly linked to said trigger member for bowstring release.

8. The improved release device of claim 7 wherein said handle directly is linked to said trigger member so that movement of said handle in said second direction effects like movement of said trigger member in said second direction to effect bowstring release.

9. An improved archery bowstring release device, said device comprising, in combination:

a. a unitary bowstring-holding member in the form of a frame having an integral pair of spaced, opposed resilient clamp jaws;

b. a trigger member intersecting said frame and pivotably connected to one of said jaws; and, c. a link pivotably connected to the other of said jaws and to said trigger member, whereby movement of said trigger member in a first direction acts through said link to force said jaws toward each other into a bowstring holding closed position, and whereby movement of said trigger member in the opposite second direction permits sudden bowstring-releasing opening of said jaws, said trigger member comprising an elongated lever arm with a forked portion adjacent one end thereof and a trigger portion adjacent the opposite end thereof, said forked portion enclosing and pivoted to a portion of said jaws and said link.

10. The improved release device of claim 9 wherein said link is pivoted to said forked portion at a point lateral of said jaws, and wherein said link is moveable into a jaw-closed stable resting position bearing against said frame at two points.

* * * * *